United States Patent [19]

Curry

[11] Patent Number: 4,574,664

[45] Date of Patent: Mar. 11, 1986

[54] POWERED BACK-UP TONGS

[75] Inventor: Vern Curry, Odessa, Tex.

[73] Assignee: Eckel Manufacturing Co., Inc., Odessa, Tex.

[21] Appl. No.: 633,711

[22] Filed: Jul. 23, 1984

[51] Int. Cl.[4] ..... B25B 17/00

[52] U.S. Cl. ..... 81/57.34; 81/57.19; 81/57.39

[58] Field of Search ..... 81/57.15, 57.16, 57.18, 81/57.19, 57.2, 57.21, 57.33, 57.34, 57.39

[56] References Cited

U.S. PATENT DOCUMENTS

| | | | |
|---|---|---|---|
| 2,544,639 | 3/1951 | Calhoun . | |
| 2,705,614 | 4/1955 | McKibben et al. . | |
| 2,737,839 | 3/1956 | Paget . | |
| 2,760,392 | 8/1956 | Paget . | |
| 2,871,743 | 2/1959 | Kelley . | |
| 2,961,904 | 11/1960 | Sergan | 81/57.39 |
| 3,025,733 | 3/1962 | Soodnizin | 81/57.19 |
| 3,518,903 | 7/1970 | Ham et al. . | |
| 3,629,927 | 12/1971 | Palmer . | |
| 3,799,009 | 3/1974 | Guier . | |
| 3,921,473 | 11/1975 | Boyadjieff et al. . | |
| 4,082,017 | 4/1978 | Eckel . | |
| 4,092,881 | 6/1978 | Jurgens et al. | 81/57.39 |
| 4,290,304 | 9/1981 | Eckel . | |
| 4,398,598 | 8/1983 | Fabrygel | 81/57.39 |
| 4,402,239 | 9/1983 | Mooney | 81/57.34 |
| 4,445,402 | 5/1984 | Farr et al. . | |

*Primary Examiner*—James L. Jones, Jr.

*Attorney, Agent, or Firm*—Carwell & Helmreich

[57] ABSTRACT

A powered back-up assembly is provided for securing a pipe against rotation. A plurality of heads are supported by a cage plate assembly, and are brought into gripping engagement with the pipe by rotating the cage plate assembly relative to a cam ring fixed to the body of the tong body. The cage plate assembly is rotated by a pair of hydraulic cylinders each connected at one end to a bar pivotably connected to the tong body. A third hydraulic cylinder interconnected between adjacent upper and lower tong bodies may be employed to achieve a reliable scissors tong, whereby the body of the upper tong is rotatable relative to the body of the lower tong.

19 Claims, 7 Drawing Figures

POWERED BACK-UP TONGS

BACKGROUND OF THE INVENTION

The present invention relates to power tongs utilized to make up or break apart pipe members and, more particularly, relates to back-up tongs utilized to secure a pipe member against rotation. The present invention also relates to tongs of the scissors type, wherein an upper body portion rotates relative to a lower body portion to achieve the high make up or break out torques commonly required for drill pipe.

Rotary power tongs are commonly used to rotate an upper tubular member, e.g., casing, drill pipe, or tubing, relative to a stationary lower tubular member, and thus threadably make up or break apart such members. When employing such powered rotary tongs, it is generally desirable to actively preclude the lower tubular member from rotation, which might otherwise occur as high torque is applied to the upper tubular member by the powered rotary tong during the initial break out or the final make up operation.

Both manual and powered back-up tongs have been utilized to grip and prevent rotation of the lower pipe. Power back-up tongs are generally preferred by tong operators over manual back-up tongs; examples of the latter tongs are described in U.S. Pat. Nos. 2,668,689 and 3,380,323. Such manual tongs generally require additional operator tasks, and may be unable to successfully grip the lower pipe against rotation when the upper pipe is subjected to high torques.

Powered back-up tongs are shown in U.S. Pat. Nos. 2,544,639 and 4,402,239, as well as U.K. Pat. No. 1,348,954. A disadvantage of such back-up tongs, however, is that the external force utilized to adequately grip the pipe to prevent rotation may apply so great a biting force as to crush the pipe. Also, closed throat back-up tongs as shown in U.S. Pat. No. 3,518,903 tend to require a great deal of field adjustment, thereby delaying the costly petroleum recovery operation, and cannot be laterally put on and taken off a section of pipe. An improved back-up tong is described in U.S. Pat. No. 4,290,304. This patent discloses a cage plate assembly which may be rotated by a hydraulic motor carrying a plurality of heads. As the cage plate assembly rotates, the heads are driven inwardly to engage the pipe by cam surfaces on a cam ring affixed to the tong body. The tong utilizes a backing lug affixed to the tong body and a backing pin assembly mounted to the cage plate to automatically align the cage plate opening with the opening in the tong body, so that the tong can be laterally put on and taken off a pipe.

Prior art tongs also include tongs generally referred to as scissors tongs, wherein the upper tong body grips an upper section of pipe, a lower tong body grips a lower section of pipe, and the bodies are then rotated relative to each other to obtain threading or unthreading of the pipe. Generally, only 10°–20° of rotation is provided for in a single scissors or rachet action, so that scissors tongs are generally utilized only for the final make up and break out torques required for certain drill pipe operations. Spinners are thus frequently utilized to thread the drill pipe sections to each other, and the scissors tong is employed for only the final 30° make up rotation or the initial 30° break out rotation requiring extremely high torques. Spinners and scissors type tongs may be combined in a single product, as shown in U.S. Pat. Nos. 2,705,614, 3,629,927, and 3,799,009.

Early embodiments of scissors-type tongs are shown in U.S. Pat. Nos. 2,737,839 and 2,871,743, wherein pivotable levers act to engage each section of pipe. A variation of a scissors-type tong is shown in U.S. Pat. No. 2,760,392, whereby the upper and lower yoke members rotate relative to each other.

A disadvantage of many of the above-referenced scissors-type tongs is that numerous operator actions are required to perform the make-up or break out operation. Scissors-type tongs may also suffer from the drawbacks previously noted in connection with certain back-up tongs, in that the power means utilized to successfully grip the pipe to prevent rotation between the heads and the pipe may be so severe that the heads crush or damage the pipe. Finally, scissors-type tongs typically employ additional mechanisms for aligning the open throat portions of the tongs, but such additional mechanisms may require further operator action or may lack reliability, so that the tongs cannot be easily and reliably put on or taken off a pipe by movement in the lateral direction.

More conventional scissors-type tongs are shown and described in U.S. Pat. Nos. 3,921,473 and 4,082,017. It should be understood that in a conventional scissors-type tong as shown in the latter patent, the upper and the lower tong portions each act to grip the upper and lower pipe sections, respectively. As shown in U.S. Pat. No. 4,082,017, the upper and lower tong sections are rotated by a cylinder interconnected between the tong sections.

SUMMARY OF THE INVENTION

A back-up tong is provided according to the present invention comprising a cam ring affixed within a tong body, a cage plate assembly rotatable relative to the cam ring and carrying a plurality of heads, and a pair of hydraulic cylinders each connected at one end to an arm pivotably connected to the tong body. One of the hydraulic cylinders is connected at its other end to the tong body, while the other hydraulic cylinder is connected at its other end to the rotatable cage plate assembly.

According to a feature of the invention, the tong body and cage plate assembly each include open throat portions so that the tong may be laterally put on or taken off the pipe. One of the hydraulic cylinders may be fully extended while the other hydraulic cylinder may be fully retracted to automatically align the open throat cage plate assembly with the tong body, thereby enabling the tong to be easily put on or taken off the pipe.

According to another feature of the invention, the cylinder end of each hydraulic cylinder is pivotably secured to the pivot bar while the rod end of each hydraulic cylinder is pivotably connected to either the tong body or the cage plate assembly. The cylinders are sized to deliver approximately the same maximum output force when both cylinders are extended or when both cylinders are both retracted, and the pivot point on the pivot arm is approximately centrally located between the two pivotable hydraulic cylinder/pivot bar connections. The two cylinders cooperate with the pivot bar to enable either make up or break out rotation of the cage plate assembly by either expanding or retracting both cylinders.

As another feature of the invention, one hydraulic cylinder may be actuated to rotate the pivot bar, while the other hydraulic cylinder is actuated to lenthen or shorten the distance between an end of the pivot bar and the rod end/cage plate connection. The combination of two cylinders with a pivot bar enables the cage plate assembly to be rotated over a greater angle than is possible with only one of these cylinders. Stated differently, the above feature allows a tong to be more compact, in that each of the above hydraulic cylinders need not be as long as a single cylinder which is capable of rotating the cage plate assembly over the same angle during a single stroke.

As a further feature of the invention, each cylinder may be in the retracted position during the break out operation, so that the maximum cage plate rotational force may be obtained by applying fluid pressure to extend each cylinder to release the heads from the pipe after the break out operation is completed.

According to another feature of the invention, the back-up tong described herein may be utilized to form a scissors-type tong having an upper and lower tong body for gripping upper and lower pipe sections, respectively. Another hydraulic cylinder is connected between the upper and lower tong bodies, and acts to rotate the upper tong body relative to the lower tong body in order to achieve a high make-up or break out torque.

These and other features, objects, and advantages of the present invention will become apparent from the following detailed description of a preferred embodiment, wherein reference is made to the Figures in the accompanying drawings.

DETAILED DESCRIPTION

Figure 1:
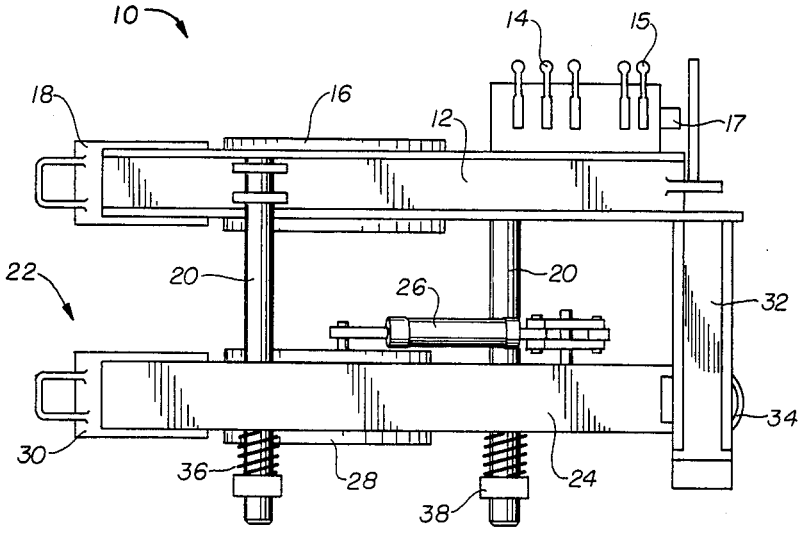
FIG. 1 is a simplified side view of an upper tong body and a powered back-up tong according to the present invention.

FIG. 1 depicts a simplified view of the power tong 10 used in conjunction with the back-up tong 22 according to the present invention for making up and breaking apart threaded tubular members, such as casing, drill pipe, and tubing commonly used in petroleum recovery operations. The power tong 10 comprises a body 12 and controls 14 for rotating cage plate assembly 16 relative to the tong body to make up or break apart joints of pipe. The power tong 10 is of the open-throat type, and includes door 18 so that the tong may be laterally put on or taken off the pipe. Suitable power tongs are shown in U.S. Pat. Nos. 3,261,241, 3,380,323, and 3,550,485. U.S. Pat. No. 4,084,453 discloses a power tong particularly suitable for use with the back-up tong of the present invention, and the latter patent is hereby incorporated by reference.

As explained more fully below, the back-up tong 22 comprises a tong body 24 and a pair of hydraulic cylinders mounted to the tong body (cylinder 26 being shown in FIG. 1) for rotating cage plate assembly 28. The tong body 24 also includes an open throat portion, which may be closed or opened by door 30 so that both the power tong and the back-up tong may be laterally put on or taken off a pipe simultaneously. The power tong body 12 and the back-up tong body 24 are prohibited from substantial rotation relative to each other by a plurality of legs 20 affixed to the power tong and extending through apertures provided in the back-up tong. The back-up tong 24 is supported on springs 36, which are retained by suitable adjustable connections 38 affixed to the legs 20. Also, a downward extending member 32 affixed to the power tong engages a load cell 24 on the back-up tong to provide a direct read out of the make up torque and prevent rotation of the upper and lower tong bodies in the make-up mode. Further details regarding the legs 20 and the load cell 34 are disclosed in U.S. Pat. No. 4,402,239, which is hereby incorporated by reference.

Figure 2:
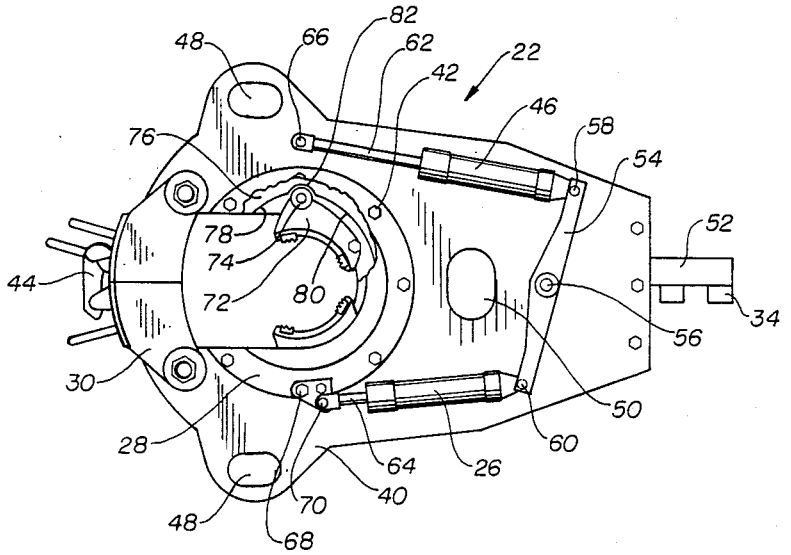
FIG. 2 is a top view of the lower back-up tong depicted in FIG. 1, with a portion of the cage plate assembly removed for clarity of the internal components.

FIG. 2 depicts a top view of the back up tong shown in FIG. 1, and the same reference numerals are used for apparatus previously discussed. The back up tong body 24 comprises a top plate 40, a bottom plate substan-tially identical to the top plate, and sidewall portions between the two plates. The cage plate assembly 28 is rotatably mounted to the tong body by a plurality of rollers secured by cage plate bolts 42. A suitable door 30 is shown having a latch mechanism 44 for minimizing spreading of the open throat tong body under high torque operations.

The drive means for rotating the cage plate assembly 28 according to the present invention comprises cylinders 26 and 46, each pivotably mounted to rigid bar 54 at pivot joints 60 and 58, respectively. The rod 62 from cylinder 46 is pivotally connected to the upper body plate 40 by upwardly extending pins 66. The rod 64 of cylinder 26 is pivotably connected at 70 to tab 68, which is affixed to the cage plate assembly 28. Pivot bar 54 pivots about pin 56 which extends upwardly from the plate 40. Pin 56 may be conveniently aligned with the center of the open throat portion of the tong body for laterally receiving the pipe. The pivot bar 54, cylinder 46, and cylinder 26 cooperate to rotate the cage plate assembly relative to the tong body, and automatically align the open throat portion of the cage plate assembly with the open throat portion of the back up tong body 24, as explained subsequently.

FIG. 2 also depicts suitable apertures 48 and 50 in both the upper and lower tong body plates for receiving downwardly extending legs 20. Arm 52 extending from the rear of the tong body supports load cell 34. The cage plate assembly 28 comprises a pair of pivotable heads 72 each carrying cam rollers 74 for engaging the camming surfaces of the cam ring 76 affixed to the tong body. The camming surfaces for each head include break out cam surface 78, make up cam surface 80, and neutral cam surface 82. The details of a suitable cam ring affixed to the tong body plates and a suitable cage plate assembly utilizing sliding heads are more fully described in U.S. Pat. No. 4,082,017, and further details regarding the camming surfaces of a suitable cam ring and another suitable embodiment of a cage plate assembly are described in U.S. Pat. No. 4,084,453.

Figure 3:
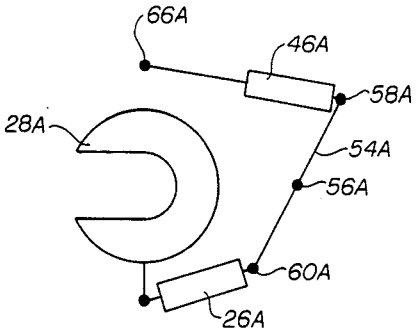
FIGS. 3, 4, and 5 are each simplistic top views of the relative positions of the cage plate assembly, the hydraulic cylinders, and the pivot arm in the neutral, make up, and break out modes, respectively.

Referring to FIG. 3, a simplified top view of the apparatus depicted in FIG. 2 is illustrated. It should be understood that the cage plate assembly 28A may be retained in the neutral position when cylinder 46A is fully extended and cylinder 46B is fully retracted. Pivot points 56 and 56A are fixed relative to the tong body, and thus the position of the pivot bar 54a and the pivot pin 60A are determined by the extension or retraction of the cylinder 46A.

Figure 4:
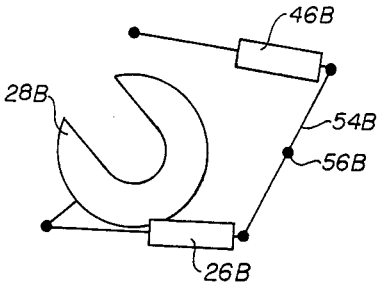

In order to place the back up tong of the present invention from the neutral position to the position to prohibit rotation of the lower pipe when the upper pipe is being made up by the rotary tong, cylinder 26B may be extended as shown in FIG. 4. Extension of the cylinder rod from the cylinder 26 rotates the cage plate assembly 28B as shown, so that each of the rollers 74 would ride up its make-up cam surface 80 of the fixed cam ring.

Figure 5:
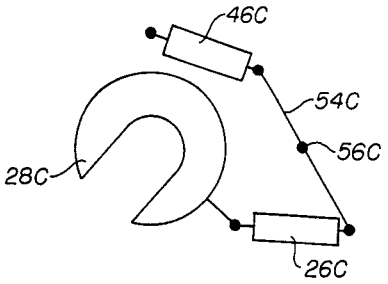

To position the back up tong from the neutral position to the position for prohibiting rotation of the lower pipe when the upper pipe is being broken apart by the rotary tong, cylinder 46C may be retracted as shown in FIG. 5. Retraction of the rod into the cylinder 46 causes rotation of the pivot bar 54 about the pivot point 56, and thereby causes rotation of the cage plate assembly 28C as shown. Each of the head rollers 74 would therefore ride up its respective break out cam surface 78 of the fixed cam ring to prohibit substantial rotation of the lower pipe during the break out operation.

It should be understood that the stroke of each cylinder 26 and 46 preferably is sufficient to allow the head roller 74 to move from the neutral position to a position up the cam surface 78 or 80 to cause the dies on the heads to come into gripping engagement with the pipe, and the maximum stroke of each cylinder 26 and 46 preferably may allow each roller to reach the end of the cam surface, if necessary. Typically, each roller may move up the cam surface a distance from between $\frac{1}{4}''$ to $\frac{3}{4}''$ from the point where the neutral cam surface engages the make up or break out camming surface, so that the roller "rides up" the camming surface $\frac{1}{4}''$ to $\frac{3}{4}''$ before the dies come into gripping engagement with the pipe. The maximum stroke of each cylinder therefore allows the cage plate to continue to rotate, moving the roller further up the cam surface, after the heads come into gripping engagement with the pipe. Also, it may be desirable to provide an adjustable pressure relief valve in the hydraulic lines to the cylinders 26 and 46, so that the maximum pressure to each cylinder can be set at a value, e.g., 1500 psi, necessary to insure good gripping engagement of the heads with the pipe. As is standard practice with power tongs, the heads associated with the back up tong of the present invention are easily interchangeable, so that the particular head size used with the back up tong would depend on the diameter of the pipe to be gripped. The controls 15 for regulating pressure to each of the cylinders 26 and 46 may be positioned in either the back-up tong body or, as shown in FIG. 1, adjacent the controls on the rotary tong. FIG. 1 also depicts a representative pressure relief valve 17 for limiting fluid pressure to the cylinders 26 and 46 in the manner described above. Neither the standard flexible fluid lines for both the power tong and the back-up tong nor the skid-mounted hydraulic power unit are shown in FIG. 1.

After the cylinders have caused the heads to come into gripping engagement with the pipe, the cylinders 26 and 46 may be either generally retracted or generally extended, as shown in FIGS. 4 and 5. Hydraulic fluid pressure to the cylinders may be discontinued during the actual make up or break out operation, or pressure to the cylinders may be maintained during this operation. As those skilled in the art will recognize, torque will be transmitted to the lower pipe as the upper power tong is rotating the upper pipe. Accordingly, torque being transmitted to the lower pipe may cause further rotation of the cage plate assembly 28 with respect to the back-up tong body, but the direction of that further rotation will cause the rollers 80 to move further up the cam surface, i.e., further away from the neutral cam surface. Thus, the cylinders 26 and 46 need not apply sufficient force to the heads to enable the dies to prevent rotation of the lower pipe during the actual make up or break out operations. These cylinders need only apply sufficient force so that the dies on the heads grip the pipe, and thereafter further biting force from the heads to the pipe will be transmitted from the rotary power tong to the pipe, allowing the cage plate assembly to move in the same direction so that the head rollers move further up the cam surface, thereby enabling more biting force to be transmitted from the heads to the pipe.

One advantage of this fixed cam ring/rotatable cage plate system in a back up tong is that no unnecessary biting force need be transmitted to the lower pipe than is necessary for the back up tong to secure the pipe against rotation. In other words, activation of the cylinders 26 or 46 may move the head rollers up the cam surface approximately $\frac{1}{2}''$ (from the end of the neutral cam surface), at which point the heads are in gripping engagement with the pipe. Thereafter, pressure on the hydraulic cylinders may be released, and the head rollers may stay in that position as torque is initially applied to the upper pipe by the rotary tong assembly. As additional torque is applied to the upper pipe, the lower pipe will tend to rotate in the same direction (only perhaps 2° to 5°), allowing the head rollers to move further up the cam surface. Thus, additional biting force will be transmitted to the pipe by the back up tong to secure the pipe against further substantial rotation as the final make up torque is applied to the rotary tong, but the force being transmitted to the pipe by the back up tong heads will not be so great as to unnecessarily cause crushing of the lower pipe by the back up tong. Thus, the biting force applied by the back up tong is automatically and directly responsive to the torque being generated by the rotary tong assembly. This feature obviously enables the cylinders 26 and 46 to be relatively lightweight yet reliable, since the cylinders do not attempt to counteract the torque applied to the pipe by the power rotary tong.

As previously indicated, it is a feature of the invention that both cylinders be generally retracted during the break out operation, as shown in FIG. 5. The benefit of this feature is that the largest amount of force from each cylinder 26 and 46 may then be generated during extension of these cylinders (by utilizing the full area of each cylinder piston). Generally the maximum desired force from the cylinders 26 and 46 will be desired to rotate the cage plate assembly back to the neutral position after the break out operation has been made. In other words, a large amount of force from the cylinders 26 and 46 need not be generated to rotate the cage plate assembly in either direction from the neutral position to enable the dies to come into and remain in gripping engagement with the pipe, as explained above. A relatively larger force from the cylinders may be required, however, to forcefully rotate the cage plate from the locked biting position back toward the neutral position, this latter problem (of overcoming friction so as to rotate the cage plate assembly from a locked position back toward the neutral position) frequently being referred to as a "back biting" problem. Break out torque frequently exceeds the make up torque, and since the back biting problem, if any, is directly related to the maximum torque being resisted by the back up tong, it is envisioned that the maximum desired force from the cylinders 26 and 46 would preferably be present after the break out operation, enabling the cylinders to overcome any back biting problem to move the cage plate assembly back to the neutral position. If sliding heads are provided in the cage plate assembly of the back up tong, biasing means such as springs may be utilized to retract the sliding heads once the cage plate assembly has been rotated back to the neutral position. A design of suitable sliding heads and biasing means is disclosed in U.S. Pat. No. 4,290,304, which is hereby incorporated by reference.

Figure 6:
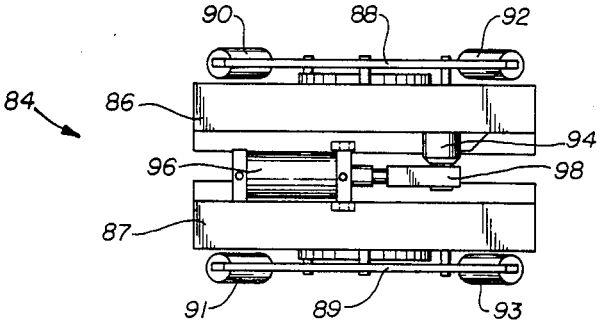
FIG. 6 is an end view of a suitable scissors tong according to the present invention.

FIG. 6 depicts a back view of a suitable scissors tong 84 according to the present invention. The scissors tong comprises an upper body assembly 86 and a lower body assembly 87, each of which may be structurally and functionally similar to the back up tong previously described. In other words, the upper body 86 comprises a pair of cylinders 90 and 92 each connected at one end to a pivot bar 88 for rotating a cage plate assembly relative to the body, and the lower tong assembly comprises a pair of cylinders 91 and 93 each connected at one end to pivot arm 89 for rotating the cage plate assembly of the lower tong body. To enable the tong bodies 86 and 87 to be in close physical relationship (which is especially desirable for drill pipe connections) the cylinders 91 and 93 and the bar 84 are provided below the lower tong plate of body 87. A principal difference between the scissors tong as shown in FIG. 6 in the assembly as shown in FIG. 1 is that the bodies 86 and 87 are designed to rotate in scissors fashion relative to one another. This rotation may conveniently be generated from hydraulic cylinder 96, which is pivotably connected at its cylinder to the lower body 87, and is pivotably connected at its rod end 98 to member 94, which in turn is fixedly connected to the upper body 86. The operation of a suitable scissors tong and further details relating to the mounting of a suitable cylinder 96 are disclosed in U.S. Pat. No. 4,084,417, which is hereby incorporated by reference.

For the present, it should be understood that during a make up operation, the cylinder 98 may first be extended so that the tong is "open", i.e., looking down on the tong assembly 84, the upper body 86 is rotated 15° counter-clockwise relative to the lower body. Thereafter, cylinders 90–93 of both the upper body 86 and the lower body 87 may be actuated, causing the dies of the upper body and lower body to both come into gripping engagement with the pipe. Cylinder 98 may then be retracted, causing the upper cylinder (again looking downward on the assembly) to move clockwise relative to the lower cylinder, thus threading the upper pipe to the lower pipe. Once the cylinder 96 has been retracted, the cylinders 90 and 92 may again be activated causing the heads of the upper body to disengage the pipe, and the process may thereafter be repeated with the cylinders 91 and 93 keeping the dies of the lower body in engagement with the lower pipe. To obtain break out, the upper and lower tong bodies may be initially aligned, cylinders 90–93 actuated so that the heads grip the upper and lower pipes, and cylinders 96 extended to cause the upper tong to rotate in the counter-clockwise direction relative to the lower tong body. As previously indicated, it would be conventional to use the scissors tong 84 only for making up the final desired make up torque or initially breaking out the threaded connection. A separate spinner assembly (not depicted) would thus be conveniently provided for making up or breaking apart the threaded connection, with the scissors tong only being utilized for the final make up or initial break out torque.

Figure 7:
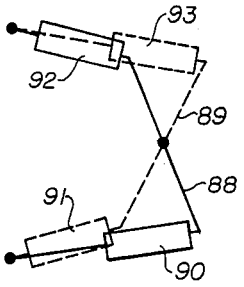
FIG. 7 is a simplified top view of the relative positions of the upper and lower cage plate rotating cylinders and the pivot arms of a scissors tong in the neutral position according to the present invention.

FIG. 7 depicts the position of the cylinders 90, 91, 92, and 93 in the neutral position, with the dashed lines representing the cylinders and the pivot bar for the lower tong body 87, and the solid lines representing the cylinders and the pivot bar for the upper tong body 86. It should be apparent that the cage plate assemblies of both the upper tong 86 and the lower tong 87 must rotate in the same direction during the make up or break out operations, and this would be accomplished (in the make up mode) by extending cylinder 92 of the upper tong body and by extending cylinder 91 above the lower tong body. In the break out mode, all four cylinders 90, 91, 92, and 93 may be retracted, which again allows for maximum force from the cylinders to overcome "back biting" so as to return the cylinders to the neutral position after the break out operation is complete. In the present case, activation of cylinder 96 causing relative rotation of bodies 86 and 87 accomplishes the work of making up or breaking apart the joint at the desired torque. Preferably cylinder 96 is configured as shown in FIG. 6 so that the maximum force from the cylinder (available when cylinder 96 is extended) is generated during the break out mode rather than the make up mode. During activation of cylinder 96 the cage plate assembly of the upper tong body 86 and the lower tong body 87 may rotate a few degrees to increase the biting force on the pipe, with this rotation being in the same direction that the head rollers were initially rotated from the neutral position to obtain biting engagement with the pipe.

It should be recognized that the terms "upper" and "lower" are relative terms which describe the conventional arrangement of the components at a drill site. The apparatus of the present invention could be utilized to make up and break apart joints of pipe in a horizontal position, in which case the equipment would be conventionally referred to as a bucking machine.

The foregoing embodiments are illustrative only to the principles of the present invention. The back-up tong and the scissors tong described herein may employ either sliding heads or hinged heads. Also, the cage plate assembly of such equipment may be supported by and rotatably guided by suitable cage plate rollers in engagement with either the partial ring member or by tong plates or both. As shown in FIG. 6, the hydraulic cylinders for rotating the cage plate assembly relative to the tong body may be provided on top of the upper plate or below the lower plate. Also, it may be desirable to provide these hydraulic cylinders and rotatable bar between the upper and lower tong plates, although the width of the tong body may have to be increased to avoid engagement of the cylinders with the cage plate assembly. Many modifications and changes may be made within the scope of the invention. The above described modification, as well as other modifications apparent to those skilled in this art are intended to be within the spirit and scope of the invention.

What is claimed is:

1. A back-up tong for securing a first tubular member against axial rotation in response to rotation of a second tubular member by a pipe-rotating device, said back-up tong comprising:

a frame member having a first opening for receiving said first tubular member;

a ring member fixedly interconnected with said frame member and having a plurality of cam surfaces on said ring member;

a cage plate assembly rotatable with respect to said ring member and having a second opening aligned with said first opening for receiving said first tubular member;

a plurality of heads carried by said cage plate assembly for being urged into engagement with said first tubular member by said cam surfaces upon rotation of said cage plate assembly;

a pivot bar rotatably mounted relative to said cage plate assembly;

a first fluid powered cylinder connected at one end to said pivot bar and connected at the other end to said frame member; and a second fluid powered cylinder connected at one end to said pivot bar and connected at the other end to said rotatable cage plate assembly.

2. A back-up tong as defined in claim 1, further comprising:

said frame member having a first open throat portion for laterally receiving said first tubular member;

said cage plate assembly having a second open throat portion for laterally receiving said first tubular member; and one of said first or second fluid powered cylinders being fully extended and the other of said fluid powered cylinders being fully retracted for automatically aligning said open throat portion of said cage plate assembly with said open throat portion of said frame member for receiving said first tubular member.

3. A back-up tong as defined in claim 1, wherein extension of both said first and said second fluid powered cylinders rotates said cage plate assembly in one direction; and retraction of both said first and said second fluid powered cylinders rotate said cage plate assembly in the reverse direction.

4. A back-up tong as defined in claim 1, wherein extension of both said first and said second fluid powered cylinders rotates said cage plate assembly in a direction to prevent rotation of said first tubular member while said second tubular member is being threadably made-up to said first tubular member; and retraction of said first and said second fluid powered cylinders rotates said cage plate assembly in another direction to prevent rotation of said first tubular member while said second tubular member is being threadably broken-apart from said first tubular member.

5. A back-up tong as defined in claim 1, wherein the pivot point for said pivot bar is approximately centrally located between the connection of said first fluid powered cylinder with said pivot bar and said second fluid powered cylinder with said pivot bar; and the maximum force of said first fluid powered cylinder when extended approximates the maximum force of said second fluid powered cylinder when extended.

6. A back-up tong as defined in claim 1, further comprising:

means for fixing said frame member of said back-up tong against substantial rotation relative to said pipe-rotating device.

7. A back-up tong as defined in claim 1, further comprising:

said frame member comprises upper and lower tong body plates;

said ring member is fixedly mounted to said frame member between said upper and lower tong body plates; and said first and said second fluid powered cylinders are mounted above said upper tong body plate.

8. A back-up tong as defined in claim 1, wherein said cam ring includes first and second cam surfaces each having a make-up cam surface, a break-out cam surface, and a neutral cam surface; and each of said first and second cam surfaces cooperates with first and second heads for engaging said first tubular member.

9. A back-up tong as defined in claim 1, wherein both said first and said second fluid powered cylinders are activated to forcibly rotate said cage plate assembly back toward a neutral position for disengaging said plurality of heads with said first tubular member.

10. A method of securing a first tubular member against axial rotation, comprising:

providing an open throat frame member having a plurality of cam surfaces affixed thereto;

providing an open throat cage plate assembly rotatable about said frame member and carrying a plurality of heads for gripping engagement with said tubular member;

providing a bar pivotable about said frame member;

activating a first fluid powered cylinder connected at one end to said frame member and connected at the other end to said pivot bar for rotating said pivot bar; and activating a second fluid powered cylinder connected at one end to said pivot bar and connected at the other end to said cage plate assembly for rotating said cage plate assembly to bring said plurality of heads into and out of said gripping engagement with said tubular member.

11. A method as defined in claim 10, further comprising:

fully extending one of said first or second fluid powered cylinders while simultaneously fully retracting the other of said first or second fluid powered cylinders for automatically aligning said open throat portion of said cage plate assembly with the open throat portion of said frame member.

12. A method as defined in claim 10, further comprising:

extending both said first and second hydraulic cylinders while rotating said cage plate assembly in one direction; and retracting both said first and second hydraulic cylinders while rotating said cage plate assembly in the reverse direction.

13. A method as defined in claim 10, further comprising:

centrally locating the pivot point for said pivot bar between connections of said first hydraulic cylinder with said pivot bar and said second hydraulic cylinder with said pivot bar; and sizing said first and second hydraulic cylinders for applying approximately the same maximum force from said hydraulic cylinders when extended.

14. The method as defined in claim 10, further comprising:

retracting one of said first or said second hydraulic cylinders while extending the other of said first or said second hydraulic cylinders to rotate said cage plate assembly for disengaging said plurality of heads with said first pipe.

15. A power tong for rotating a first tubular member relative to a second tubular member, said power tong comprising:

a first open throat tong frame member having a first plurality of cam surfaces affixed thereto;

a second open throat tong frame member having a second plurality of cam surfaces affixed thereto;

first and second cage plate assemblies each rotatable about said first and second frame members, respectively, and carrying a plurality of heads for gripping engagement with said first and second tubular members, respectively;

first and second pivot bars pivotable about said first and second frame members, respectively;

a first pair of cylinders each connected at one end to said first pivot bar for rotating said first cage plate assembly and a second pair of cylinders each connected at one end to said second pivot bar for rotating said second cage plate assembly; and a torque cylinder interconnected between said first and second frame members for rotating said first frame member relative to said second frame member and thereby rotating said first pipe relative to said second pipe.

16. A power tong as defined in claim 15, wherein one of said first pair of cylinders and one of said second pair of cylinders is fully extended while the other of said first pair of cylinders and the other of said second pair of cylinders is fully retracted for automatically aligning said first and second cage plate assemblies with open throat portions of said first and second frame members.

17. A power tong as defined in claim 15, wherein said first and second pairs of cylinders each comprises:

a tong body cylinder connected at the other end to said first or second frame members, respectively; and a cage plate cylinder connected at the other end to said first or second cage plate assemblies.

18. A power tong as defined in claim 15, wherein said first and said second frame members each comprises:

a ring member fixedly mounted to said first or second frame member, respectively, and having a plurality of cam surfaces on said ring member for engagement with said plurality of heads.

19. A power tong as defined in claim 18, wherein both said first and second pairs of cylinders may be activated to forcibly rotate said first and second cage plate assemblies, respectively, back toward a neutral position for disengaging said plurality of heads from said first and second tubular members.

* * * * *